US006003866A

United States Patent [19]

Tsai

[11] Patent Number: 6,003,866

[45] Date of Patent: Dec. 21, 1999

[54] PRESSURE CONTROL DEVICE OF A BUOYANCY DISK GAME MACHINE

[76] Inventor: Peter Tsai, 1F, No. 16, Shih-Chieh Street, Hsin Chu, Taiwan

[21] Appl. No.: 09/012,221

[22] Filed: Jan. 23, 1998

[51] Int. Cl.[6] ..... A63F 7/00

[52] U.S. Cl. ..... 273/126 A

[58] Field of Search ..... 273/126 R, 126 A; 416/93 R, 181; 415/77

[56] References Cited

U.S. PATENT DOCUMENTS 3,385,516 5/1968 Omohundro ..... 416/93 R
3,449,605 6/1969 Wilson ..... 416/93 R
3,773,325 11/1973 Crossman et al. ..... 273/126 A
4,150,919 4/1979 Matucheski ..... 416/93 R
5,788,231 8/1998 To ..... 273/126 A X

*Primary Examiner*—Raleigh W. Chiu
*Attorney, Agent, or Firm*—Harold L. Novick; Gregory B. Kang; Nath & Associates

[57] ABSTRACT

A pressure control device of buoyancy disk game machine comprises a motor and a fan, characteristic in that a plurality of openings are installed on the pillar of the fan. Thereby, the reversed pressure within the space of the game machine may be released from the opening, thus the wind resistance of the fan blade may be reduced, and the motor temperature is also reduced.

8 Claims, 3 Drawing Sheets

PRESSURE CONTROL DEVICE OF A BUOYANCY DISK GAME MACHINE

BACKGROUND OF THE INVENTION

The present invention is related to a pressure control device, especially to a pressure control device of a buoyancy disk game machine.

DESCRIPTION OF THE PRIOR ART

FIG. 1 shows a buoyancy disk game machine. On the planar table (B1) of the buoyancy disk game machine (B) is installed a plurality of slender holes (B2). A pressure control device (A) is installed on a closed space in pneumatic communication with the reverse side of the table (B1). The pressure control device (A) includes a motor mounted to a body and a frame that is used to rotate a fan so that said closed space is compressed to a proper pressure. Thus, the air pressure may be released from said slender holes (B2) so as to form an air cushion on the surface of table (B1) and the buoyancy disk (C) on the table can be frictionlessly slid freely on said air cushion.

However, when operating said pressure control device (A), in the structure of said buoyancy disk game machine (B), a reversed pressure will be formed on the fan blade due to the air pressure formed on the closed space. Consequently the load of the motor is increased and thus the temperature of the motor coil is also increased.

In order to avoid the defect of said reversed pressure, in general the gap between the free end portion of the fan blade and the periphery of the pressure control device is increased about 5 mm and said reversed pressure may be released through this gap.

However, as the gap between the free end portion of the fan blade and the periphery of the pressure control device is increased, the flow of air absorbed by said fan will be interrupted by the reversed pressure, and in consequence, the drawback of unsteady air wind pressure is caused.

SUMMARY OF THE INVENTION

A pressure control device of buoyancy disk game machine comprises a motor, a body, a frame and a fan characteristic in that an interstitial partitioning spacer is installed on the frame in close proximity to the fan and on the pressurized side thereof. A plurality of openings are installed on the pillar of the fan. Thereby, the reversed pressure within the space of the game machine may be isolated from the absorbed air flow and said reversed pressure may be funneled to and released through the plurality of openings installed in the fan pillar. Thus the wind resistance on the fan blade may be reduced. In addition, during the process that the reversed pressure within the space of the game machine is released through the openings, the air flow through the motor will cool the coil of the motor so that the operating temperature of the motor may be retained within a safe range.

The present invention will be better understood and its numerous objects and advantages will become apparent to those skilled in the art by referencing the following drawings in which:

DETAILED DESCRIPTION OF THE PREFERRED EMBODIMENT

Figure 1:
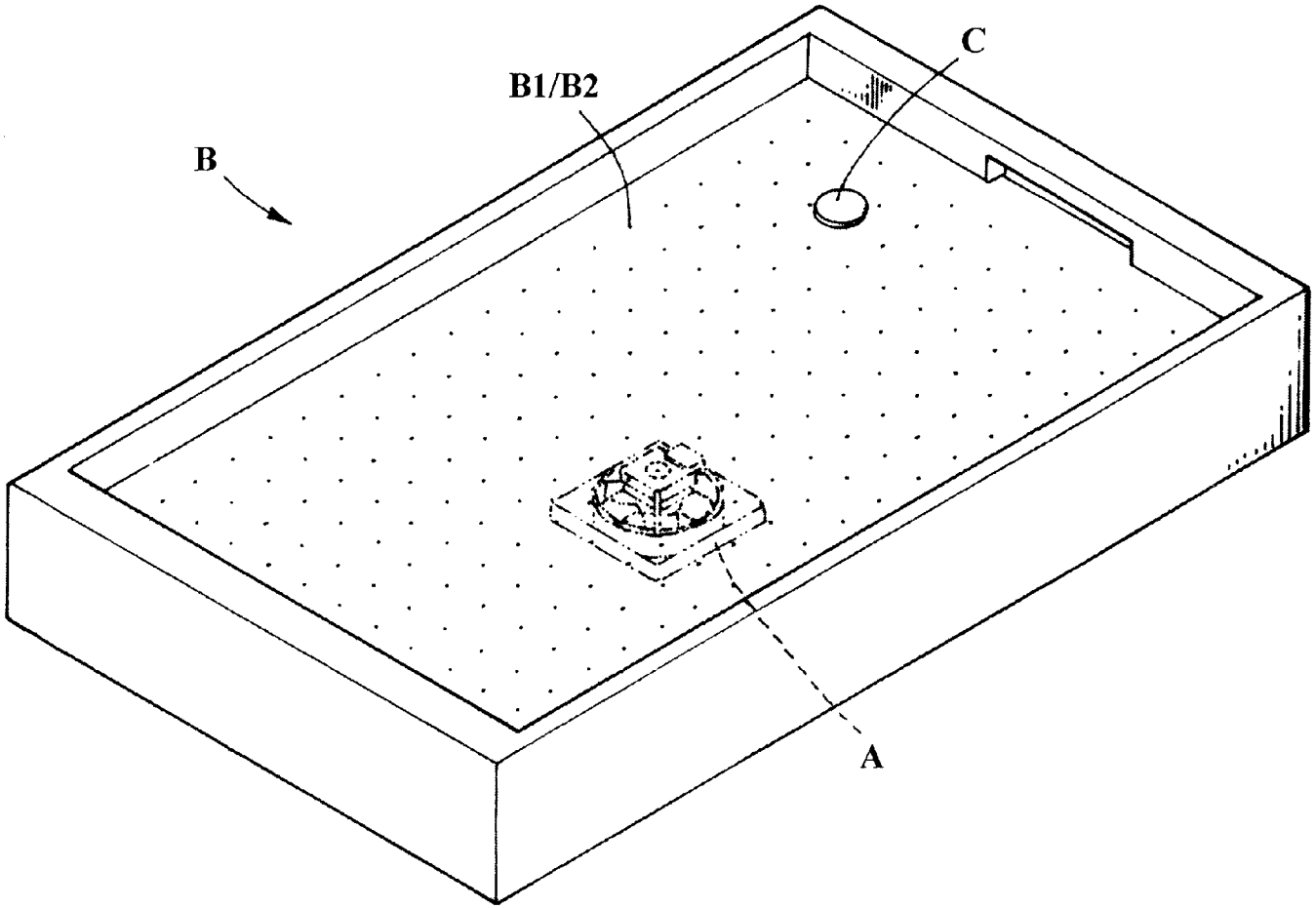
FIG. 1 shows the appearance of the buoyancy disk game machine.
Figure 2:
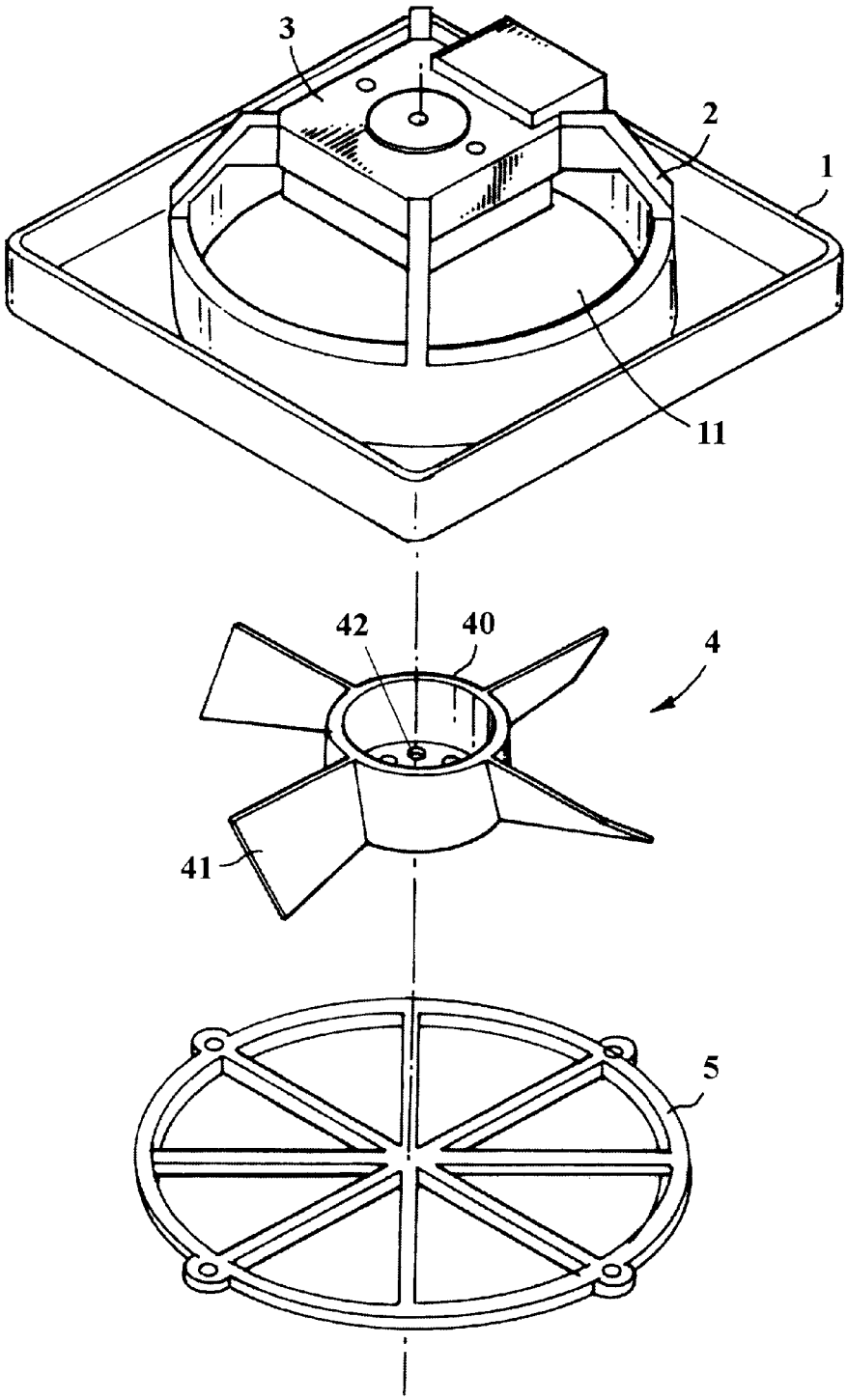
FIG. 2 shows the pressure control device of the present invention.

The present invention will be described in detail in the following and additionally by referring to FIGS. 2 and 3.

Figure 4:
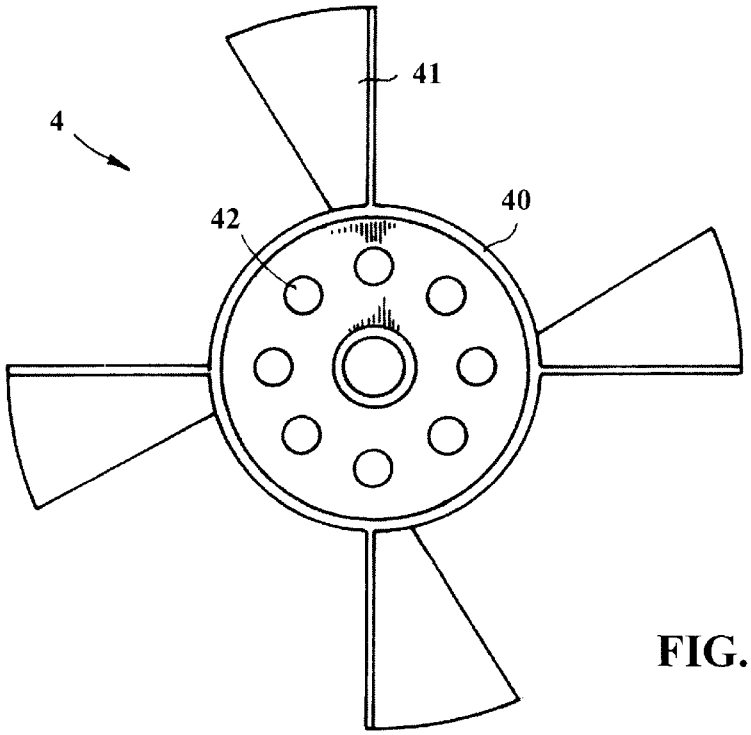
FIG. 4 is a plan view of the fan of the present invention.

The pressure control device (A) of said buoyancy disk game machine (B) comprises a body (1) the center of which is installed with a round hole (11) and the periphery of the round hole (11) has a frame (2) extending therefrom to a proper height which is used to support a motor (3) to a predetermined position. The motor (3) has a driven output shaft (31) extending therefrom. A fan (4) is fixedly installed on the motor shaft (31), as shown in FIG. 4. The fan (4) has a pillar (40) on the center thereof. A plurality of openings (42) are installed on the pillar (40) of the fan. A plurality of blades (41) are extended radially outward, with equal angles, from the periphery of the pillar (40).

Figure 3:
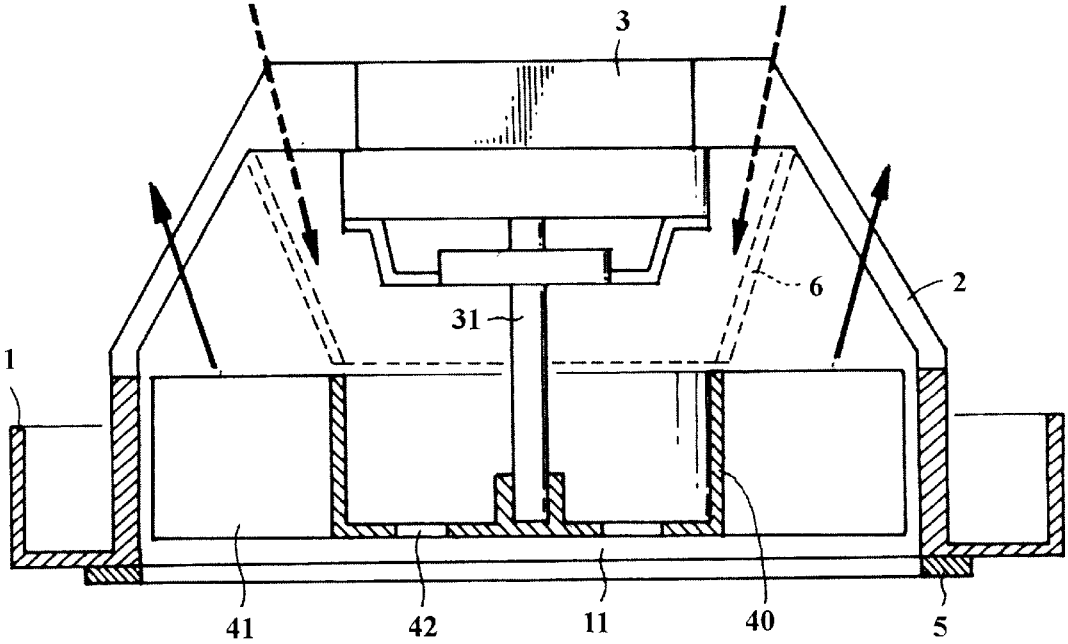
FIG. 3 is a front cross-sectional view of FIG. 2.

As said motor (3) is actuated so that the fan (4) is rotated according to a predetermined direction, the blades (41) of the fan (4) will absorb air from the round hole (11) of the body (1) so to form an increased air pressure on the closed space of the game machine, as shown by the arrow denoted by the solid line in FIG. 3. However, since the line speed on the free end of the blades (41) is larger than the line speed of the base end of said blades, the absorption force on the free end portion of the blades (41) is larger than that on the base end.

The increased air pressure on the closed inner space of the game machine (B) forms a reversed pressure to said fan blades (41). Since within the range of the fan pillar (40) and the base end of the blades (41) no absorbing force or only a small absorbing force is generated, a plurality of openings (42) are installed on the pillar (40) of the fan (4). Thus, said reversed pressure may be released out from the openings (42), as shown by the arrow denoted by the dashed line of FIG. 3. The wind resistance inducing from the reversed pressure on the fan blades (41) may thereby be reduced.

The direction that the fan blades (41) absorb air is opposite to the direction that the reversed pressure is released. Therefore, interruption between the absorbing air flow and the releasing air flow will reduce the efficiency of said pressure control device (A). Thus in the modified embodiment of the present invention the absorbing and releasing air flows are separated by an interstitial partitioning spacer (6) with trumpet shape which is axially aligned with the fan (4) and installed on said frame (2) in close proximity to the fan (4), as shown by the dashed line in FIG. 3. The diameter of the end of the spacer (6) nearest the fan pillar (40), is set to be equal to that of the fan pillar (40). Thereby, the range over which said fan (4) absorbs air may be completely separated from the range over which the reversed pressure is released. Therefore, the predetermined function of the present invention is improved.

Further, under the process that the reversed pressure generated from the inner space of the game device (B) is released from the openings (42), the air flow through the motor (3) will cool the coil of the motor (3) and thereby maintain the operating temperature of the motor (3) within a safe range.

Since said reversed pressure may be released from the openings (42) of the fan (4) the gap between the end portion of the fan blade (41) and the frame (2) may be reduced to about 1 mm–2 mm. Thus, the defect of the unsteady wind pressure in the prior art may be avoided.

Although a certain preferred embodiment of the present invention has been shown and described in detail, it should be understood hat various changes and modifications may be made therein without departing from the scope of the appended claims.

I claim:

1. A pressure control device for a buoyancy disk game machine comprising a motor and a fan, said fan having a pillar, characterized in that:

a plurality of openings are installed on the pillar of the fan.

2. A pressure control device for a buoyancy disk game comprising a frame and a fan mounted on said frame, wherein a spacer is located on the frame, and the lower portion of said spacer is near the upper portion of the fan pillar and the circumference thereof is approximately equal to that of the fan pillar.

3. The pressure control device for the buoyancy disk game machine as claimed in claim 2, wherein said frame has an opening defined by a peripheral wall; and further comprising fan blades having an outer radial end portion; and wherein there is a gap between the end portion of the fan blades and the peripheral wall of the frame of 1 mm–2 mm.

4. A pressure control device for a buoyancy disk game machine comprising a motor, a frame with a circular opening therein, and a fan driven by said motor and mounted with respect to said circular opening so as to produce air flow through said opening wherein said fan is comprised of a fan pillar to which a plurality of fan blades are affixed, and characterized in that a plurality of openings are in the pillar of the fan.

5. The pressure control device for the buoyancy disk game machine as claimed in claim 4, wherein a spacer is installed on the frame, in close proximity to the fan and on the high-pressure side of said fan, and the lower portion thereof is near the upper portion of the fan pillar and the circumference thereof is approximately equal to that of the fan pillar.

6. The pressure control device as claimed in claim 5 wherein the spacer is in axial alignment with said fan.

7. The pressure control device as claimed in claim 5, and further comprising an enclosed space which has a top and which top comprises a table having a plurality of holes there-through, said table having an upper surface on which surface a disk can be slid and a bottom surface which forms the top of the closed space.

8. The pressure control device for the buoyancy disk game machine as claimed in claim 4, wherein the gap between the end portion of the fan blades and the circular opening of the frame is set to 1 mm–2 mm.

* * * * *